US006795661B2

(12) United States Patent
Kanesawa et al.

(10) Patent No.: US 6,795,661 B2
(45) Date of Patent: Sep. 21, 2004

(54) IMAGE FORMING APPARATUS

(75) Inventors: Yoshio Kanesawa, Kanagawa (JP); Yutaka Nogami, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/236,923

(22) Filed: Sep. 9, 2002

(65) Prior Publication Data

US 2003/0180063 A1 Sep. 25, 2003

(30) Foreign Application Priority Data

Mar. 19, 2002 (JP) ..... P. 2002-076724

(51) Int. Cl.[7] ..... G03G 15/20

(52) U.S. Cl. ..... 399/69; 399/67; 399/320; 399/328

(58) Field of Search ..... 399/67, 68, 69, 399/88, 320, 322, 328, 329, 341, 400; 347/156; 219/216

(56) References Cited

U.S. PATENT DOCUMENTS 5,099,288 A * 3/1992 Britto et al. ..... 399/320
5,436,711 A * 7/1995 Hauser ..... 399/328
5,890,032 A * 3/1999 Aslam et al. ..... 399/69
5,899,599 A * 5/1999 Kato ..... 399/69
5,983,048 A * 11/1999 Moser ..... 399/67
6,026,274 A * 2/2000 Aslam et al. ..... 399/329
6,512,914 B2 * 1/2003 Kabashima ..... 399/341

FOREIGN PATENT DOCUMENTS

JP 4-31389 B 5/1992
JP 4-31393 B 5/1992
JP 5-127413 5/1993

* cited by examiner

*Primary Examiner*—Sandra L. Brase
(74) *Attorney, Agent, or Firm*—Morgan, Lewis & Bockius LLP

(57) ABSTRACT

An image forming apparatus includes an image forming unit for forming an unfixed toner image on a recording sheet, a first fixing unit for fixing the unfixed toner image on the recording sheet, a second fixing unit for further fixing the toner image on the recording sheet fixed by the first fixing unit, and a control unit for selecting a first fixing mode in which only the first fixing unit is used for fixing the toner image on the recording sheet or a second fixing mode in which the first and second fixing unit are used for the fixing. The width of the recording sheet, which the second fixing unit can fix is narrower than of the recording sheet 16, which the first fixing unit can fix.

21 Claims, 9 Drawing Sheets

IMAGE FORMING APPARATUS

The present disclosure relates to the subject matter contained in Japanese Patent Application No.2002-76724 filed on Mar. 19, 2002, which are incorporated herein by reference in its entirety.

BACKGROUND OF THE INVENTION

1. Field of the Invention

The present invention relates to an image forming apparatus based on electrophotography, such as a copying machine, printer, facsimile machine, and a complex machine having the functions of those machines. More particularly, the invention relates to the improvement of the arrangement of a plurality of fixing devices and the control of it.

2. Description of the Related Art

A known electrophotography-basis image forming apparatus, for example, such a color image forming apparatus as a color copying machine or a color printer, has the following construction. The image forming apparatus is provided with only one photo receptor drum. Color toner images of yellow (Y), magenta (M), cyan (C), black (BK), and the like are successively formed on the photo receptor drum. The color toner images of yellow (Y), magenta (M), cyan (C), black (BK), and the like, which are successively formed on the photo receptor drum, are transferred onto a recording sheet in a superimposing fashion. Those toner images are heated and fused onto the recording sheet, to thereby form a color image. In another known color image forming apparatus, the color toner images of yellow (Y), magenta (M), cyan (C), black (BK), and the like, which are successively formed on the photo receptor drum, are primarily transferred onto the intermediate transfer body in a superimposing fashion. Those color, toner images having been transferred onto the intermediate transfer body are secondarily transferred onto a recording sheet simultaneously. Those toner images are heated and fused on the recording sheet to thereby form a color image.

Yet another known color image forming apparatus is provided with a plurality of image forming units of yellow (Y), magenta (M), cyan (C), black (BK), and the like. The color toner images of yellow (Y), magenta (M), cyan (C), black (BK), and the like, which are successively formed onto the photo receptor drums of the image forming units, are transferred onto a recording sheet in a superimposing fashion or primarily transferred onto the intermediate transfer body. The color toner images having been transferred onto the intermediate transfer body are secondarily transferred onto the recording sheet simultaneously. Those toner images are heated and fused on the recording sheet to thereby form a color image.

The color toner that is transferred and fused onto the recording sheet, normally, is formed such that a colorant made of pigment or dyestuffs is dispersed or molten and mixed into binder resin. The particle diameter is selected to be several $\mu$m to several tens $\mu$m. Such color toners are transferred onto a plain paper or coated paper, e.g., general printing paper, in a state that a plurality of layers of color toner are superimposed, and then fixed onto a plain paper or coated paper, e.g., general printing paper, while being heated and molten. At this time, an undulation of the toner layer makes the surface of the color image uneven of 10 to 100 $\mu$m in height, and hence, its surface gloss is made irregular. As a result, the color image formed on a plain paper or coated paper, e.g., general printing paper, reflect diffusely incident illumination light When observed by the naked eye, the color image is poor in glossiness.

The following techniques for producing images with good glossiness are known.

JP-A-5-127413 discloses a color image forming method in which a transparent resin layer is located on the surface of a transfer body, and color toner is fixed on the transparent resin layer to thereby form a color image. The resultant image is rich in tone, excellent in color reproducibility, high in resolution, and good in glossiness. The color image forming method disclosed by JP-A-5-127413 melts and fixes the color toner onto the transfer body to form a color image. In the image forming method, the transparent resin layer formed of at least thermoplastic resin, 20 to 200 $\mu$m thick, is located on the surface of the transfer body. Color toner of 3 to 9 $\mu$m in volume averaged grain size is stuck onto the transparent resin layer by the quantity of 0.2 to 4.0 mg/cm$^2$, and then heated, molten and fixed to form a color image.

JP-B-4-31389 and JP-B-4-31393 disclose techniques of a picture quality improving method and a picture quality improvement processing device. In those publications, a sheet is applied on a fixed toner image which has been discharged from the image forming apparatus, and heated under pressure. Then, the sheet is cooled and stripped off the toner image. A shape of the sheet surface is replicated to provide a glossy image.

A possible approach to produce a color image forming apparatus capable of forming a color image having good glossiness is that a toner image, not yet fixed, is formed on the recording sheet by image forming unit, such as a known color copying machine or a color printer, is fixed by fixing means, and second fixing unit, additionally provided, further fixes the image on the recording sheet to thereby increase the glossiness of the toner image.

The following power consumption problem arises in the image forming apparatus having first and second fixing unit, however.

Usually, the commercial AC source power is frequently used up to its tolerable upper limit power, 1.5 kVA (100 V, 15 A), in order to secure higher copying productivity for plain papers.

When examining the items of its power consumption, the power consumption by the fixing unit for fusing and fixing the toner image by thermal energy is large, generally 600 to 1000 W. The power consumption of the image processing and image forming sections other than the fixing means is approximately 800 W.

The second fixing unit for the gloss increasing process further consumes electric power of 700 to 1,300 W by its heating source. Additionally, electric power of 250 W is consumed by the image processor for high quality image, and power of 50W, for the driving of the second fixing unit and its cooling fan driving. When the first and second fixing unit are concurrently driven, the maximum power consumed by the whole apparatus, greatly exceeds 1.5 kVA, and reaches a value near 3.0 kVA.

Even if two electrical outlets of the commercial power source are provided, the power consumption by the image forming apparatus must be 2.0 kVA at the maximum in use environments of general offices and homes since the 20 A breaker is used for the main power source. To use the electric power of 2.0 kVA or higher, extensive power supply work is required in use environments, and this should be avoided if possible.

SUMMARY OF THE INVENTION

Accordingly, an object of the present invention is to provide an image forming apparatus, which is capable of producing an image of high gloss without increasing the power capacity.

According to a first aspect of the invention, there is provided an image forming apparatus having an image forming unit for forming an unfixed toner image on a recording sheet, a first fixing unit for fixing the unfixed toner image on the recording sheet, a second fixing unit for further fixing the toner image on the recording sheet, which is fixed by the first fixing unit, and a control unit for selecting one of a first fixing mode in which only the first fixing unit is used for fixing the toner image on the recording sheet and a second fixing mode in which the first and second fixing unit are used for the fixing. Width of the recording sheet, which the second fixing unit can fix is narrower than that of the recording sheet, which the first fixing unit can fix. For example, the width of the recording sheet (for example, the long side of A4), which the second fixing unit can fix is narrower than the half (for example, the post card width and the width of the photograph of L size) of the width of the recording sheet, which the first fixing unit can fix.

According to a second aspect of the invention, there is provided an image forming apparatus having an image forming unit for forming an unfixed toner image on a recording sheet, a first fixing unit for fixing the unfixed toner image on the recording sheet at a predetermined temperature, a second fixing unit for further fixing the toner image on the recording sheet, which is fixed by the first fixing unit, and a control unit for selecting one of a first fixing mode in which only the first fixing unit is used for fixing the toner image on the recording sheet and a second fixing mode in which the first and second fixing unit are used for the fixing. The control unit sets the predetermined temperature of the first fixing unit in the second fixing mode to be lower than that of the first fixing unit in the first fixing mode.

According to a third aspect of the invention, there is provided an image forming apparatus having an image forming unit for forming an unfixed toner image on a recording sheet, a first fixing unit including a first heating source, the first fixing unit for fixing the unfixed toner image on the recording sheet, a second fixing unit including a second heating source, the second fixing unit for further fixing the toner image on the recording sheet, which is fixed by the first fixing unit, and a control unit for controlling electric power supplied to the first and second heating sources. The control unit executes such a control that a timing of supplying electric power to the first heating source is not coincident with a timing of supplying electric power to the second heating source.

According to a fourth aspect of the invention, there is provided an image forming apparatus having an image forming unit for forming an unfixed toner image on a recording sheet, a first fixing unit including a first heating source, the first fixing unit for fixing the unfixed toner image on the recording sheet at a first predetermined temperature, a second fixing unit including a second heating source, the second fixing unit for further fixing the toner image on the recording sheet, which is fixed by the first fixing unit at a second predetermined temperature, and a control unit for controlling electric power supplied to the first and second heating sources. When temperature of the first fixing unit and temperature of the second fixing unit are below the first and second predetermined temperature, respectively, the control unit supplies electric power to one of the first and second heat source, which is smaller in thermal capacity than the other. A thermal capacity of the first fixing unit may be smaller than that of the second fixing unit.

According to a fifth aspect of the invention, there is provided an image forming apparatus having an image forming unit for forming an unfixed toner image on a recording sheet, a first fixing unit including a first heating source, the first fixing unit for fixing the unfixed toner image on the recording sheet, a second fixing unit including a second heating source, the second fixing unit for further fixing the toner image on the recording sheet, which is fixed by the first fixing unit, and a control unit for controlling electric power supplied to the first and second heating sources. The second heating source includes a plurality of heating source elements; and wherein the control unit supplies electric power to the second heating source so that a quantity of heat generated by the second heating source at a timing of supplying electric power to the first heating source is smaller than that at a timing of supplying no electric power to the first heating source.

When the second heating source includes a plurality of heating source elements, electric power may be supplied to the heating source elements of the second heating source so that a quantity of heat generated by the second heating source at the timing of supplying electric power to the first heating source is smaller than that at the timing of supplying no electric power to the first heating source. In the image forming apparatus, the second heating source includes two heating source elements which are different in generated heat quantity, and at the timing of supplying electric power to the first heating source, the control unit supplies electric power to one of the two heating source elements forming the second heating source, which is smaller in generated heat quantity, and at the timing of supplying no electric power to the first heating source, the control unit supplies electric power to one of the two heating source elements forming the second heating source, which is larger in generated heat quantity.

The invention provides an image forming apparatus having an image forming unit for forming an unfixed toner image on a recording sheet, a first fixing unit including a first heating source, for fixing the unfixed toner image on the recording sheet, a second fixing unit including a second heating source, for further fixing the toner image on the recording sheet, which is fixed by the first fixing unit, and a control unit for controlling electric power supplied to the first and second heating sources. The second heating source includes three heating source elements. The control unit performs such a control that the timings of supplying electric power to the first heating source and one of the heating source elements of the second heating sources are not coincident with each other, and that the timings of supplying electric power to the remaining two heating source elements of the second heating source are not coincident with each other. The maximum power consumption by the first heating source is preferably equal to the maximum power consumption by one of the heating source elements of the second heating sources. Preferably, the maximum power consumption by the remaining two heating source elements are (substantially) equal to each other. The maximum power consumption by one of the heating source elements of the second heating source is larger than that by the remaining two heating source elements.

According to a sixth aspect of the invention, there is provided an image forming apparatus having an image forming unit for forming an unfixed toner image on a recording sheet, a first fixing unit including a first heating source, the first fixing unit for fixing the unfixed toner image on the recording sheet, a second fixing unit including a second heating source, the second fixing unit for further fixing the toner image on the recording sheet, which is fixed by the fist fixing unit, and a control unit for controlling electric power supplied to the first and second heating sources. When electric power is simultaneously supplied to the first heating source and the second heating source, the control unit supplies cut-off power to the first and second heating sources so that the sum of supplied electric power is below a predetermined power value.

1) In the image forming apparatus, the preset power value may be below a maximum power consumption value which is the larger of the maximum power consumption values of the first heating source and second heating source.

2) The preset power value may be equal to a maximum power consumption value which is the larger of the maximum power consumption values of the first heating source and second heating source.

3) The maximum power consumption values of the first heating source and second heating source are preferably equal to each other.

The technical ideas of the first to sixth image forming apparatus may appropriately combined to another image forming apparatus. To this end, the technical ideas of the first and second image forming apparatus maybe combined. The technical ideas of the third and fourth image forming apparatus may also be combined. Further, the technical ideas of the first image forming apparatus and/or second image forming apparatus and the third image forming apparatus and/or fourth image forming apparatus may be combined for the same purpose. The technical ideas of the first image forming apparatus and/or the second and fifth image forming apparatus may be combined. Additionally, the first image forming apparatus and/or second image forming apparatus and the sixth image forming apparatus may also be combined, if necessary.

The second fixing unit may include a plurality of rolls, and an endless belt stretched around the rolls, and a recording sheet is brought into close contact with a surface of the endless belt, and cooled, and peeled off the endless belt.

DETAILED DESCRIPTINO OF THE PREFERRED EMBODIMENTS

The preferred embodiments of the invention will be described with reference to the accompanying drawings.

Figure 1:
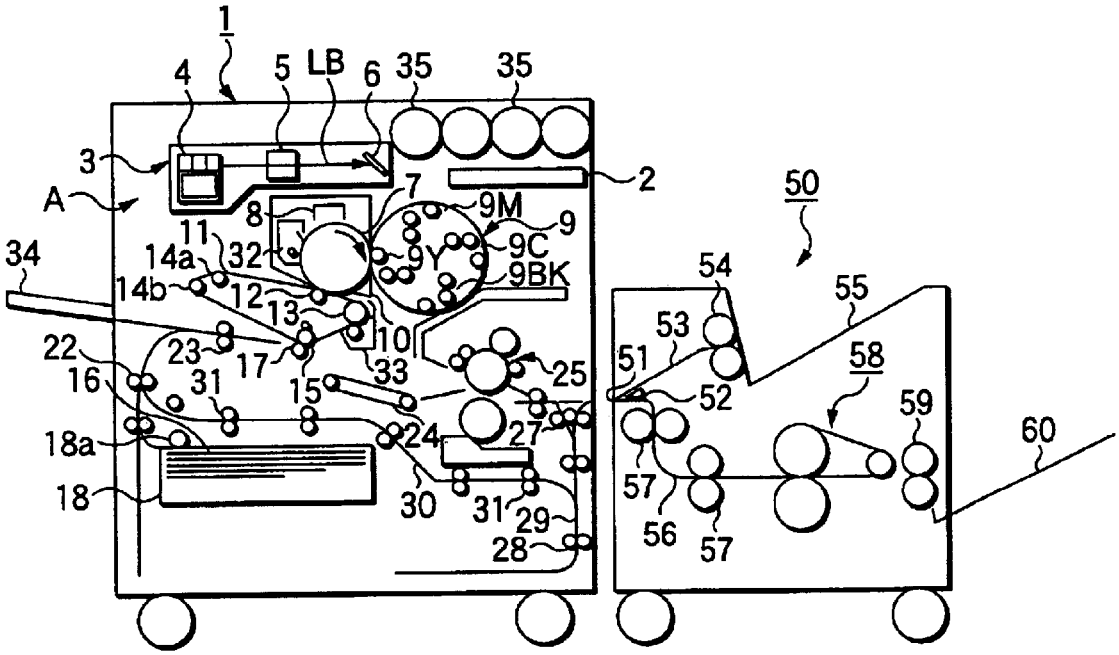
FIG. 1 is a diagram showing an image forming system which is an embodiment of the present invention.

FIG. 1 is a diagram showing an image forming system according to an embodiment of the present invention, including a color image forming apparatus 1 and a secondary fixing unit 50. In the embodiment, the secondary fixing unit 50 is located on the side of the color image forming apparatus 1, but it may be located above the color image forming apparatus 1.

The color image forming apparatus 1 receives color image information from a host computer, such as a personal computer (not shown), and/or color image information of a color document read by an image reader (not shown). In the color image forming apparatus 1, an image processing device 2, if necessary, executes the following processes on the input color information: shading correction, offset correction, lightness/color space conversion, gamma correction, frame elimination, color/move editing, and others.

The image data having undergone given image process or processes in the image processing device 2 is sent to a ROS (raster output scanner) 3 in the form of colorant gradation data of yellow (Y), magenta (M), cyan (C), black (BK) (each consisting of 8 bits). In the ROS 3, an image exposure is carried out in accordance with original colorant gradation data, by using laser light.

An image forming unit capable of forming toner images of different colors is disposed within the color image forming apparatus 1. The image forming unit includes mainly a photosensitive drum 7 as an image carrying body on which an electrostatic latent image is formed, a scorotron 8 as a charging device for uniformly charging the surface of the photosensitive drum 7, the ROS 3 as an image exposure unit for exposing the surface of the photosensitive drum 7, and a developing unit 9, which develops the electrostatic latent image on the photosensitive drum 7 into a plurality of toner images of different colors.

The ROS 3, as shown in FIG. 1, modulates a semiconductor laser device (not shown) in accordance with document reproduction colorant gradation data, and the semiconductor laser device emits a laser beam LB dependent on the gradation data. The laser beam LB emitted from the semiconductor laser device is deflected by a rotary polygon mirror 4, and is incident on the photosensitive drum 7 as an image bearing body by way of a f·β lens 5 and a reflecting mirror 6, and scans the surface of the photosensitive drum.

The photosensitive drum 7, which is exposed and scanned by the laser beam LB from the ROS 3, is driven and rotated at a given speed in arrow direction by means of a drive means (not shown). The surface of the photosensitive drum 7 is charged to be at a potential of predetermined polarity (e.g., minus polarity) by a developing device 9 as a primary charging charger, and is exposed and scanned by the laser beam LB containing the document reproduction colorant gradation data, whereby an electrostatic latent image is formed on the drum surface.

The developing unit 9 of the rotary type, which includes developing devices 9Y, 9M, 9C and 9BK of four colors, yellow (Y), magenta (M), cyan (C), and black (BK), inversion develops the electrostatic latent, image formed on the photosensitive drum 7 into toner images of given colors by using toners (charged colorant) charged to have the minus potential of minus polarity, which is the same as that of the photosensitive drum 7. Spherical toner of, for example, 5.5 μm in average particle diameter is used for the developing devices 9Y, 9M, 9C and 9BK of the developing unit 9. The toner image formed on the photosensitive drum 7 is charged to have minus polarity by the pre-transfer charging device 10 when necessary, and the amount of charge is adjusted.

Toner images formed on the photosensitive drum 7 are transferred onto an intermediate transfer belt (image forming unit) 11 as an intermediate transfer member, which is located under the photosensitive drum 7 by a primary transfer roll (image forming unit) 12 as first transferring means. The intermediate transfer belt 11 is rotatably supported by a drive roll 13, follower roll 14*a*, tension roll 14*b* and a back-up roll 15 which forms a part of the secondary transfer means and serves as an opposite roll which forms apart of the secondary transfer means. At this time, the intermediate transfer belt rotates at a moving speed equal to the periphery speed of the photosensitive drum 7 in an arrow direction.

All or some of toner images of four colors, yellow (Y), magenta (M), cyan (C), black (BK), which are formed on the photosensitive drum 7, are transferred onto the intermediate transfer belt 11 in accordance with colors of an image to be formed in a superposing fashion, by means of the primary transfer roll 12. The toner image that have been transferred onto the intermediate transfer belt 11 is transferred onto a recording sheet 16 as a recording medium which is transported to the secondary transfer position at a given timing, by a pressing force and an electrostatic attraction force of the back-up roll 15 supporting the intermediate transfer belt 11 and a secondary transfer roll (image forming unit) 17 forming a part of the second transfer means to be in pressing contact with the back-up roll 15.

The recording sheet 16 of given size, as shown in FIG. 1, is supplied form a sheet cassette 18 as a transfer sheet containing body, which is located in a lower part within the color image forming apparatus 1, by means of a sheet cassette 18. The recording sheet 16 supplied is transported to a secondary transfer position of the intermediate transfer belt 11 at a given timing, by means of a plurality of transport rolls 22 and a register roll 23. The toner images of given colors, as described above, are simultaneously transferred from the intermediate transfer belt 11 onto the recording sheet 16 by means of the back-up roll 15 and the secondary transfer roll 17 as the secondary transfer means.

The recording sheet 16 having the toner images of given colors transferred from the intermediate transfer belt 11 is separated from the intermediate transfer belt 11, and then is transferred to a first fixing device (first fixing unit) 25 by the transporting belt 24. Then, the toner image is fixed, under heat and pressure, on the recording sheet 16 by ht first fixing device 25.

Figure 2:
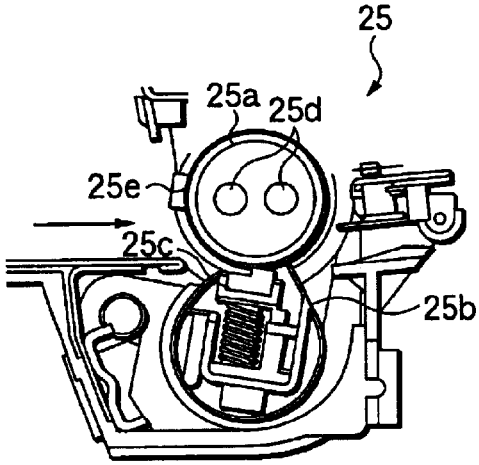
FIG. 2 is a diagram showing a first fixing device of the roll type used in the color image forming apparatus constructed according to the invention.

The first fixing device 25 is a pressure-belt type fixing device having a fuser roll 25*a* of small thermal capacity, a pressure belt 25*b* and a pressure pad 25*c* as shown in FIG. 2. The fuser roll 25*a* is constructed such that a surface of an aluminum core of 1.5 mm in thickness, 25 mm in outside diameter, and 380 mm in length is covered with a silicone rubber elastic layer having rubber hardness (JIS-A) of 33°. A release layer formed with a PFA tube of 30 μm thick is formed over the surface of the elastic layer. A halogen lamp 25*d* as a heating source is disposed within the fuser roll 25*a*. The fuser roll 25*a* is internally heated so that the surface thereof has a preset temperature TS1. A temperature sensor 25*e* is attached to the surface of the fuser roll 25*a* to sense a temperature thereon.

The pressure belt 25*b* is constructed such that a release layer formed with a PFA tube of 30 μm thick is formed over a surface of a polyimide belt of 75 μm in thickness, 30 mm in outside diameter and 330 mm in length. A fixed pressure pad 25*c* is disposed within the pressure belt 25*b*. The pressure pad 25*c* presses the pressure belt 25*b* against the fuser roll 25*a* to form a nip. A pressing force of the pressure pad 25*c* is 33 kg, and its nip width is 6.5 m. No heat source is contained in the pressure belt 25*b* and pressure pad 25*c*.

In the embodiment, the recording sheet 16 having a full color toner image transferred thereto, as shown in FIG. 1, is subjected to a fixing process again, viz., a secondary fixing process, by a second fixing device (second fixing unit) 58 of the fixing belt type in the secondary fixing unit 50.

In the embodiment, the second fixing device 58 has the following construction. A fixing belt is rotatably supported by a plurality of rolls inclusive of a heating roll. A pressing roll is brought into pressing contact with the heating roll with the aid of the fixing belt. A recording sheet is made to pass through a pressing part between the fixing belt and the pressing roll so that the toner image is positioned on the fixing belt side. The toner image is heated under pressure and fixed, the recording sheet is stuck onto the fixing belt, and in a state that the fixing belt is cooled somewhat, the recording sheet is separated from the fixing belt.

The secondary fixing unit 50 includes an introducing port 51 through which the recording sheet 16 which has been discharged from the first fixing device in the color image forming apparatus 1, is introduced. A select gate 52 is provided on the inner side of the introducing port 51, and selects a transport path of the recording sheet 16. When the recording sheet 16 that is discharged from the color image forming apparatus 1 is not subjected to the second fixing process, and directly discharged into an external, first discharge tray, the select gate 52 selects a first transporting path 53 located in an upper part, and the recording sheet is discharged into a first discharge tray 55. When the recording sheet 16 that is discharged from the color image forming apparatus 1 is subjected to the second fixing process, the select gate 52 selects a second transporting path 56 in a lower part. The recording sheet is transported to the second fixing device 58 by a plurality of transporting rolls 57, and is subjected to a gloss-increasing process by the second fixing device 58, and is discharged into a second discharge tray 60 by a discharge roll 59.

Figure 3:
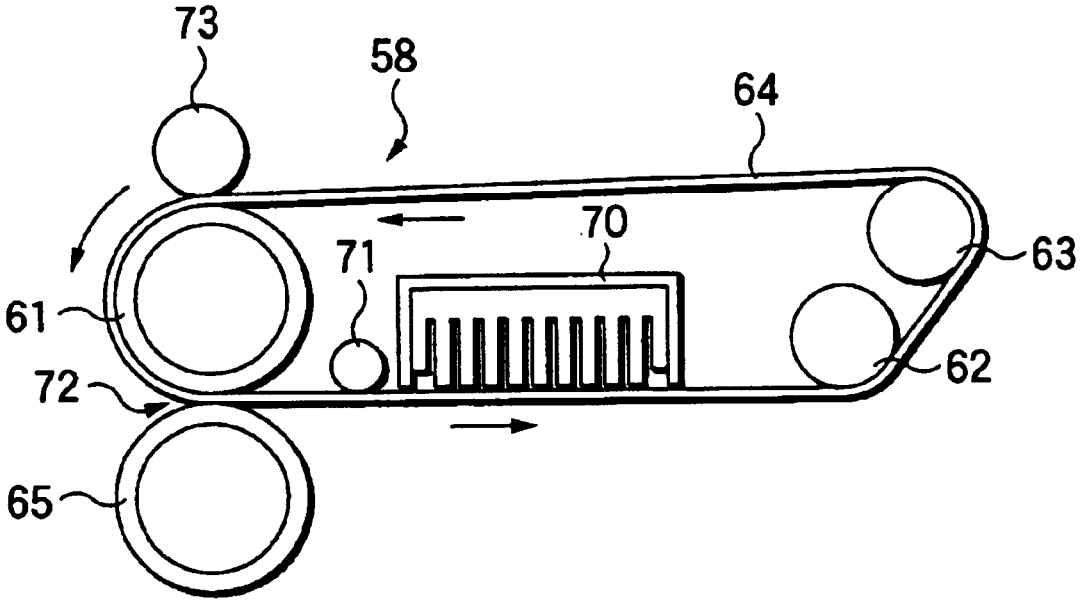
FIG. 3 is a diagram showing a second fixing device of the belt type used in the color image forming apparatus constructed according to the invention.

The second fixing device 58, as shown in FIG. 3, is constructed with a fuser roll 61, a fixing belt 64 rotatably supported by a plurality of rolls 62, 63 and the fuser roll 61, and a pressure roll 65 for pressing the fixing belt 64 against the fuser roll 61.

The fuser roll 61 is constructed such that a surface of a metal core made of steel and of 4 mm in thickness, 50 mm in outside diameter, and 180 mm in length is covered with a release layer formed with a PFA tube of 30 $\mu$m thick. A halogen lamp 69 as a heating source is disposed within the fuser roll 61, and it is internally heated so that the surface of the fuser roll 61 has a preset temperature TS2. The pressure roll 65 is constructed such that a surface of an steel core of 2 mm in thickness, 46 mm in outside diameter, and 180 mm in length is covered with a silicone rubber elastic layer having rubber hardness (JIS-A) of 40° and 2 mm in thick, and a release layer formed with a PFA tube of 30 $\mu$m thick is formed over the surface of the elastic layer.

The pressure roll 65 is pressed 64 against the fuser roll 61 by a pressing unit (not shown) with the fixing belt 64, for example intervening therebetween. In this case, a pressing part (nip part) is 6.5 cm in width, and load acting thereon is 10 kg/cm$^2$.

The fixing belt 64 is rotatably supported by the fuser roll 61, stripping roll 62 and walk control roll 63. The belt is driven and rotated at a given moving speed (50 mm/sec) by the fuser roll 61 driven by a drive source (not shown). The fixing belt 64 used is such that an endless film made of thermoset polyimide of 80 $\mu$m thick, 528 mm in peripheral length and 130 mm in width is covered with a silicone rubber layer of 35 $\mu$m thick. The belt is preferably thin in the light of power consumption, but it is preferable that the polyimide base is 75 $\mu$m or greater in the light of strength, and the silicone rubber layer is 30 $\mu$m or greater in the light of picture quality.

On the inner side of the fixing belt 64, a heat sink 70 for forcibly cooling the fixing belt 64 is provided between the fuser roll 61 and the stripping roll 62. The heat sink 70 forms a cooling/sheet transporting section for cooling and transporting the recording sheet 16. A tension roll 71, small in diameter, for imparting a fixed tension to the fixing belt 64 is provided between the heat sink 70 and the fuser roll 61.

Thus, the image forming system of the embodiment includes the color image forming apparatus 1, such as a color copying machine or a printer, which forms a toner image on a recording sheet, fixes the toner image on the recording sheet by the first fixing device 25, and discharges the recording sheet having the fixed toner image out of the apparatus 1, and the secondary fixing unit 50, provided outside the apparatus, which includes the second fixing device 58 for processing the discharged toner image to increase its gloss.

A first reason why such a construction is employed is that the image forming system capable of producing a color image having excellent gloss can be provided with less increase of developing cost without applying design modification to the conventional color image forming apparatus 1, such as color copying machine or color printer. A second reason is that a second fixing device 28 is capable of producing a color image of excellent gloss if a dedicated paper is used, but is applicable insufficiently to the plain paper.

Fluorine plastic such as PFA, PTFE and FEP, and rubber material such as silicone or fluorine rubber may be used for the release material of the belt surface of the second fixing device 28. Where the fluorine plastic, such as PFA, is used, since it is soft, the PFA surface is scarred by the paper edge of the plain paper when only several tens of papers are passed through the fixing device, and the scar is replicated on the surface of the toner image. When the rubber material, such as silicone rubber or fluorine rubber, is used for the release layer, it is not scarred since it is elastic. When the plain paper is used for the recording sheet, paper dust is accumulated on the rubber, so that its releasing performance degradation and glossiness reduction occur. When a toner image is formed on the dedicated glossy paper having the transparent resin layer, there is no chance that paper dust comes in contact with the release layer, the problem of the releasing performance degradation and glossiness reduction does not arise. The materials are both free from the peeling-off problem if the system in which the recording sheet is peeled off following the heating/melting process.

For the above reasons, the image forming system of the embodiment uses two fixing devices, the first and second fixing devices 25 and 58. When a plain paper 16*a* is selected for the recording sheet 16, the fixing process is executed by only the first fixing device 25. When a dedicated glossy paper 16*b* is selected for the recording sheet 16', the toner image is fixed again by the second fixing device 58 after passing through the first fixing device 25, to thereby execute a gloss-increasing process on the image.

A structure of the dedicated glossy paper 16*b* applied to the image forming system and how a toner image on the dedicated glossy paper 16*b* is re-fixed by the second fixing device 58, will be described with reference to FIGS. 4 and 5.

Figure 4:
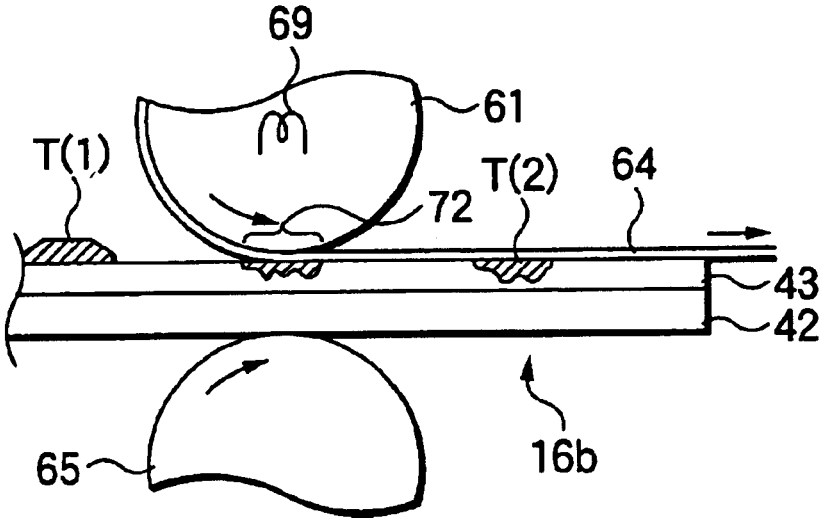
FIG. 4 is a diagram showing a gloss-increasing process by the second fixing device.
Figure 5A:
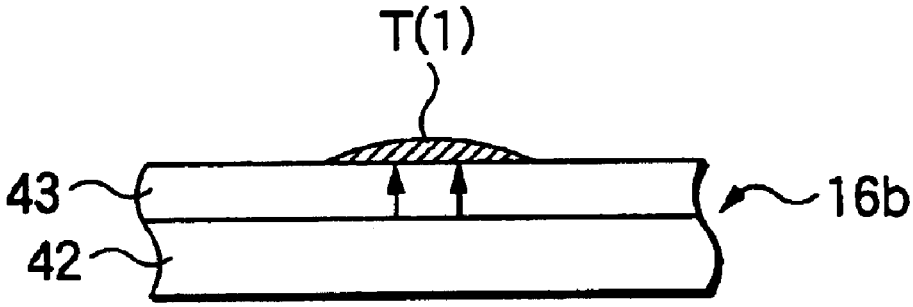
FIG. 5 is a cross sectional view showing surface configurations of a sample in a normal print mode and a high gloss mode.
Figure 5B:
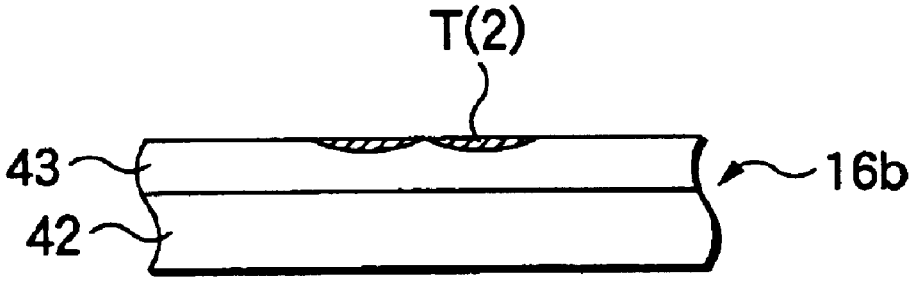

As shown in FIGS. 4 and 5, in the dedicated glossy paper 16*b*, a coated paper substrate 42 is used as a base. In the coated paper substrate, coating layers are formed on the obverse and reverse sides of a support member. A transparent image receiving layer (transparent resin layer) 43 is formed on one (surface) of the major surfaces of the coated paper substrate 42. The image receiving layer is made of a material consisting predominantly of thermoplastic resin and has a thickness of a value between 5 to 20 μm, e.g., 10 μm.

And, in the second fixing device 58, as shown in FIG. 4, a dedicated glossy paper 16*b* having a color toner image T(1) transferred and fixed to the surface thereof is introduced to a pressing contact part (nip part) 72 between the fuser roll 61 and the pressure roll 65 in a state that the color toner image T(1) is located closer to the fuser roll 61. At the pressing contact part, the pressure roll 65 is pressed to the fuser roll 61 with the fixing belt 64 being interposed therebetween. A state of the dedicated glossy paper 16*b* when it is discharged from the first fixing device 25 and before it is introduced to the pressing contact part 72, is shown in FIG. 5(*a*). The color toner image T(1) is temporarily buried in the image receiving layer 43, and thereafter the color toner image T(1) gradually and slightly emerges on the surface of the dedicated glossy paper 16*b*.

When the dedicated glossy paper 16*b* passes through the pressing contact part 72 between the fuser roll 61 and the pressure roll 65 of the second fixing device 58, the color toner image T is heated and molten, and fixed on the recording sheet 16. At this time, the image receiving layer 43 that is formed on the surface of the recording sheet 16 is also heated and softened, so that it is in close contact with the surface of the fixing belt 64.

At the pressing contact part 72 between the fuser roll 61 and the pressure roll 65, the toner is heated and molten at about 130 to 150° C. The dedicated glossy paper 16*b* having the color toner image T fixed onto the image receiving layer 43, together with the fixing belt 64, is transported in a state that the image receiving layer 43 is in close contact with the surface of the fixing belt 64. During the transportation, the fixing belt 64 is forcibly cooled by the cooling tension roll 71, and the color toner image T and the image receiving layer 43 are cooled to a temperature below the melting temperature, and solidified. Then, it is peeled off by the stripping roll 62 and a rigidity of the recording sheet 16 per se.

A state of the dedicated glossy paper 16*b* after it is discharged from the second fixing device 58 is shown in FIG. 5(*b*). The color toner image T(2) is buried in the image receiving layer 43, and sufficiently cooled and solidified. The surface of the dedicated glossy paper 16*b* has a high smoothness and exhibits an excellent glossiness.

Figure 6:
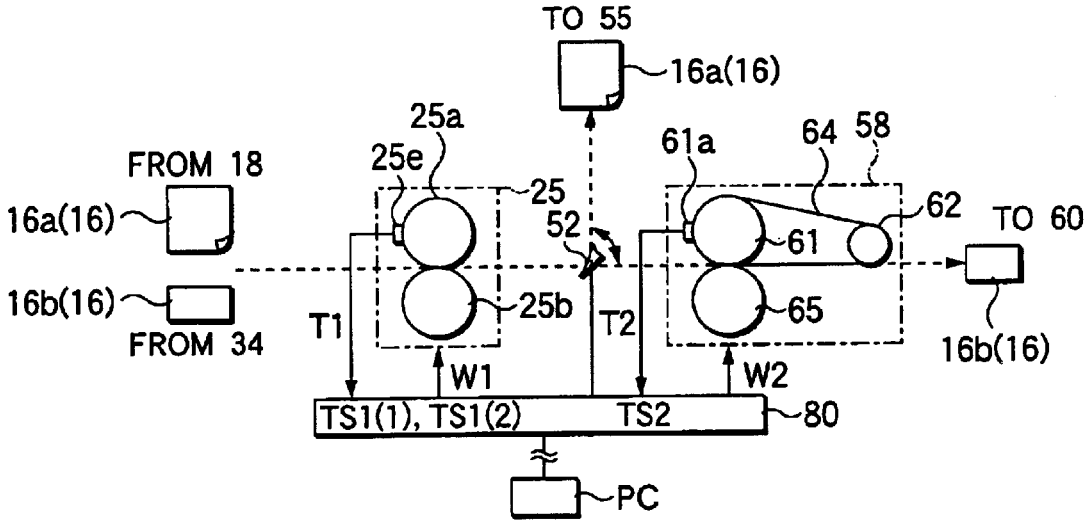
FIG. 6 is a block diagram showing a control system in the image forming system which is an embodiment of the present invention.

FIG. 6 is a block diagram showing a control system in the image forming system. A configuration of the control system will first be described. The control system is constructed around a control part 80. Examples of objects to be measured by the control part 80 are mode information, temperature information T1, and temperature information T2. The mode information indicates either a normal print mode (first fixing mode) or a high gloss print mode (second fixing mode), which are coming from a personal computer PC located outside the image forming system. The temperature information T1 is derived from the temperature sensor 25*e* attached to the surface of the fuser roll 25*a* of the first fixing device 25. The temperature information T2 is derived from the temperature sensor 61*a* attached to the surface of the fixing belt 64 of the second fixing device 58. Examples of objects to be controlled by the control part 80 are an operation of the path select member 52 for selecting the transport path of the recording sheet 16 discharged from the first fixing device 25, electric power W1 supplied to the halogen lamp 25*d* as a heating source of the first fixing device 25, and electric power W2 supplied to the halogen lamps 69 as a heating source of the second fixing device 58.

The personal computer PC, control part 80 and path select member 52 form a path control system of the recording sheet 16. The temperature sensor 25*e*, control part 80 and halogen lamp 25*d* form a temperature control system of the first fixing device 25. The temperature sensor 61*a*, control part 80 and halogen lamps 69 form a temperature control system of the second fixing device 58.

Operation of the control system will be described hereunder. When mode information is transmitted from the personal computer PC to the control part 80, the following controls will be performed in accordance with the contents of the mode information.

When the received mode information indicates a normal print mode, the control part 80 outputs a control command to the recording sheet transporting unit, not shown, and a plain paper 16*a* is fed from the sheet cassette 18. A color toner image T is secondarily transferred onto the plain paper 16*a* on the basis of the electrophotographic process. The toner image on the plain paper 16*a* is fixed by the first fixing device 25. At this time, under control of the temperature control system of the first fixing device 25, electric power W1(1) is supplied to the halogen lamp 25*d* so that a surface temperature of the fuser roll 25*a* of the first fixing device 25 reaches a preset temperature TS1(1), which is preset in the control part 80. The plain paper 16*a* discharged from the first fixing device 25 is transported by way of the path select member 52 and discharged into the first discharge tray 55.

When the received mode information indicates a high gloss print mode, the control part 80 outputs a control command to the recording sheet transporting unit, not shown, and a dedicated glossy paper 16*b* is fed from a manual cassette 34. The toner image on the dedicated glossy paper 16*b* is fixed by the first fixing device 25 (see FIG. 5(*a*)). A color toner image T is secondarily transferred onto the dedicated glossy paper 16*b* based on the electrophotographic process. At this time, under control of the temperature control system of the first fixing device 25, electric power W1(2) is supplied to the halogen lamp 25*d* so that a surface temperature of the fuser roll 25*a* of the first fixing device 25 reaches a preset temperature TS1(2), which is preset in the control part 80.

The dedicated glossy paper 16*b* discharged from the first fixing device 25 is transported by way of the path select member 52 to the second fixing device 58, and the toner image on the dedicated glossy paper 16*b* is re-fixed by the second fixing device (see FIG. 5(*b*)). At this time, under control of the temperature control system of the second fixing device 58, electric power W2 is supplied to the halogen lamp 69 so that a surface temperature of the fixing belt 64 of the second fixing device 58 reaches a preset temperature TS2, which is preset in the control part 80.

Thus, in the normal print mode, the images of low and medium gloss levels are produced by passing the plain paper 16*a* or the coated paper through only the first fixing device 25. When the high gloss print mode is selected, a dedicated glossy paper 16*b* with a transparent image receiving layer 43 is used, and a toner image thereon is temporarily fixed by the first fixing device 25, and passed through the second fixing device 58. The image on the paper output from the second fixing device is a high gloss image substantially uniform over the entire image surface.

Levels of gloss of the output image when the image forming system of the embodiment is operated in the normal print mode and the high gloss print mode are tabulated in FIG. 1.

TABLE 1

| Image gloss | <Normal print mode> only first fixing device | <High gloss mode> first fixing device + second fixing device |
|---|---|---|
| Gloss at 20° incident angle | 15 | 87 |
| (Gloss at 75° incident angle) | (40) | (105) |

For high gloss images, a level of gloss is preferably 80 or higher for the incident angle 20° gloss (100 or higher for the incident angle 75° gloss). For the image on the plain paper, a level of gloss is preferable 35 to 45 for the incident angle 75° gloss. Gloss levels of output images when the image forming system of the embodiment is operated in the normal print mode and the high gloss print mode, satisfies those conditions.

The image forming system thus constructed uses two fixing devices 25 and 58. Accordingly, the power consumption by the image forming system is likely to be excessive. Techniques for producing a high gloss color image with less power consumption will be described in the form of embodiments 1 to 3.

Embodiment 1

A first measure to reduce the power consumption, which is employed in the embodiment, is to reduce the size of the second fixing device 58, in particular, the belt width of the fixing belt 64.

The second fixing device 58 in the embodiment repeats such a cycle that the recording sheet 16 (including the dedicated glossy paper 16*b*), together with the fixing belt 64, is heated and cooled. Accordingly, in general, the power consumption by the second fixing device is considerably large.

Figure 7:
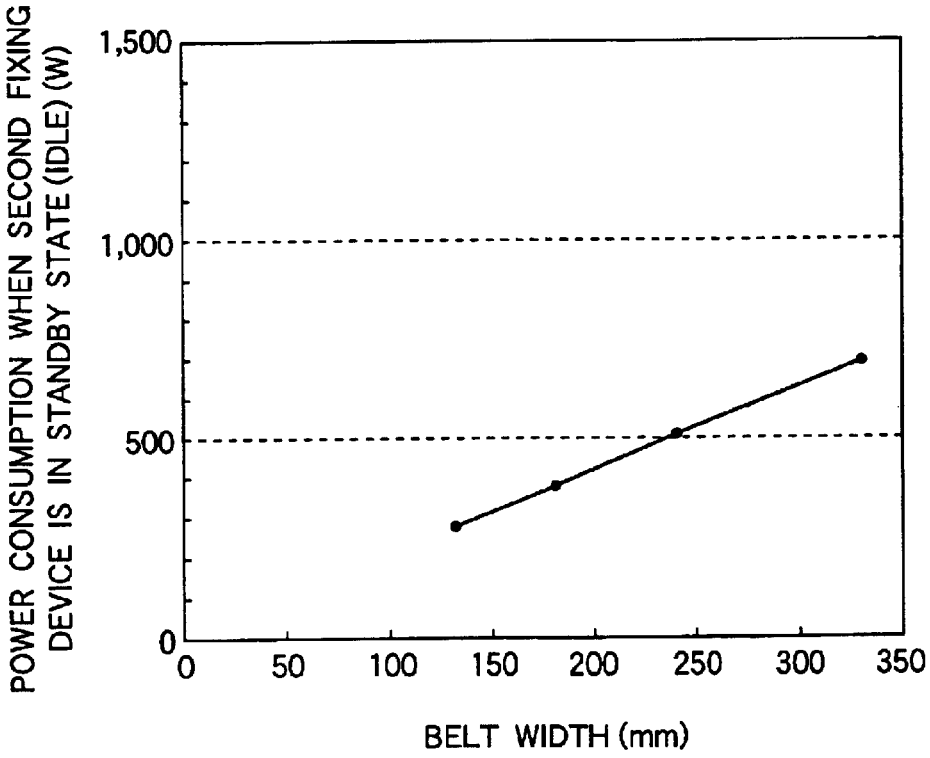
FIG. 7 is a graph showing power consumption when the second fixing device is in a standby state.

FIG. 7 is a graph explaining a relationship between the power consumption of the second fixing device 58 when it is idle (8 ppm) and the fixing belt 64. The power consumption of four kinds of the second fixing devices 58 of which the fixing belts 64 are different in width when those are in idle are measured (Those fixing belts were 130, 180, 240, and 330 mm in width.). The measured power consumption for the belt widths are plotted on the, graph, and the plotted points are connected by straight lines. As seen from the graph, the power consumption is proportional to the belt width, and the power loss by the fixing belt 64 is great.

Figure 8:
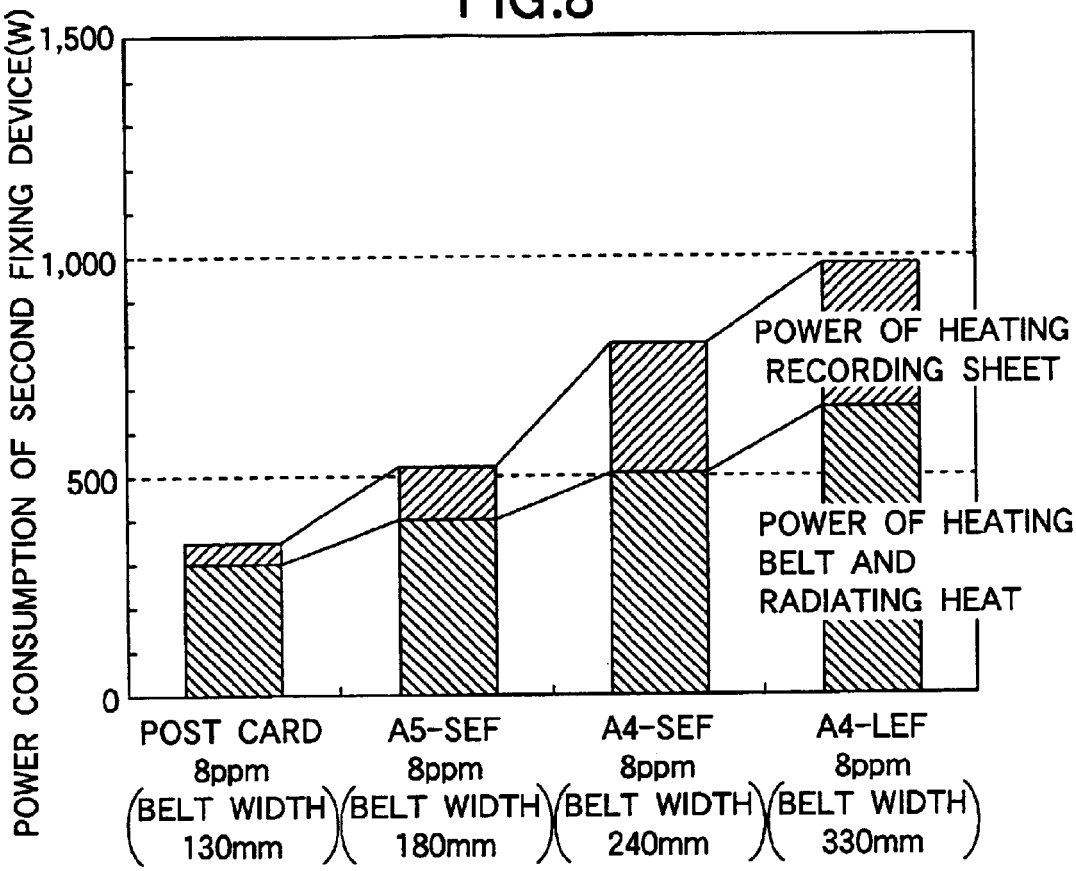
FIG. 8 is a graph showing power consumption when the second fixing device is operating for fixing.

FIG. 8 is a graph explaining a relationship between the power consumption of the second fixing device 58 when it fixes the recording sheet 16 (at 8 ppm), and the fixing belt 64. The power consumption of four kinds of the second fixing devices 58 of which the fixing belts 64 are different in width were measured (Those fixing belts were 130, 180, 240, and 330 mm in width.). The bar graph represents the power consumption for each belt width in the sum of the power consumption by the heating of the recording sheet and the power consumption by the heating and the cooling cycle of the fixing belt 64. As also seen from the graph, in this instance, the power consumption is proportional to the belt width and the recording sheet width, and the power loss by the second fixing device 58 is great.

For example, when the second fixing device 58 of the maximum sheet size of the second fixing device 58 is fed in an A4 lateral feeding mode, electric power of about 1,000 W is consumed by only the second fixing device 58. The unfixed toner image forming part and the first fixing device 25 require electric power of 1,500 W. Accordingly, a total of 2.5 kW or larger is needed for the whole image forming system.

To cope with this, in the embodiment, the width of the recording sheet 16, which the second fixing device 58 can fix, is narrower than that, which the first fixing device 25 can fix. Specifically, the second fixing device 58 is designed to be used exclusively for printing postcards and photograph of L size (89 mm×127 mm), which have strong market demands in the field of high glossy image printing. With this, the power consumption of the second fixing device 58 is reduced to 380W. It is noted that the first fixing device 25 can handle the recording sheets of size up to A3.

A second measure employed in the instant embodiment is to set the set temperature TS1 of the first fixing device 25 at low values in order to reduce the power consumption.

It suffices to design the first fixing device 25 such that the first fixing device 25 temporarily fixes the color toner image to such an extent that no offset of the color toner image occurs. There is no need to completely fix the image. Accordingly, since the preset temperature of the first fixing device 25 is set to be lower, the power consumption is correspondingly reduced.

Table 2 tabulates gloss levels of the output images when the system is operated in the normal print mode and the high gloss print mode when the preset temperature TS1 of the first fixing device 25 is set at 170° C. (TS1(1)) and 140° C. (TS1(2)).

TABLE 2

| Image gloss | Only first fixing device | First fixing device + second fixing device |
|---|---|---|
| When first fixing device 25 is set at 170° C. | 15 | 87 |
| | (40) | (105) |

TABLE 2-continued

| Image gloss | Only first fixing device | First fixing device + second fixing device |
|---|---|---|
| When first fixing device 25 is set at 140° C. | 12<br>(25) | 87<br>(105) |

upper row: gloss at 20° incident angle;
lower row (within brackets): gloss at 75° incident angle As seen from the table 2, in the normal print mode, when the preset temperature of the first fixing device 25 is set to be (relatively) low, the gloss level of the output image is lowered. In the high gloss print mode, however, even if the preset temperature of the first fixing device 25 is set to be (relatively) low, the gloss level of the output image having undergone the second fixing process, is not affected. For this reason, in the embodiment, the preset temperature TS1(2) of the first fixing device 25 in the high gloss print mode is set to be lower than the preset temperature TS1(1) of the first fixing device 25 in the normal print mode. Specifically, TS1(1)=170° C., and TS1(2)=140° C.

Figure 9:
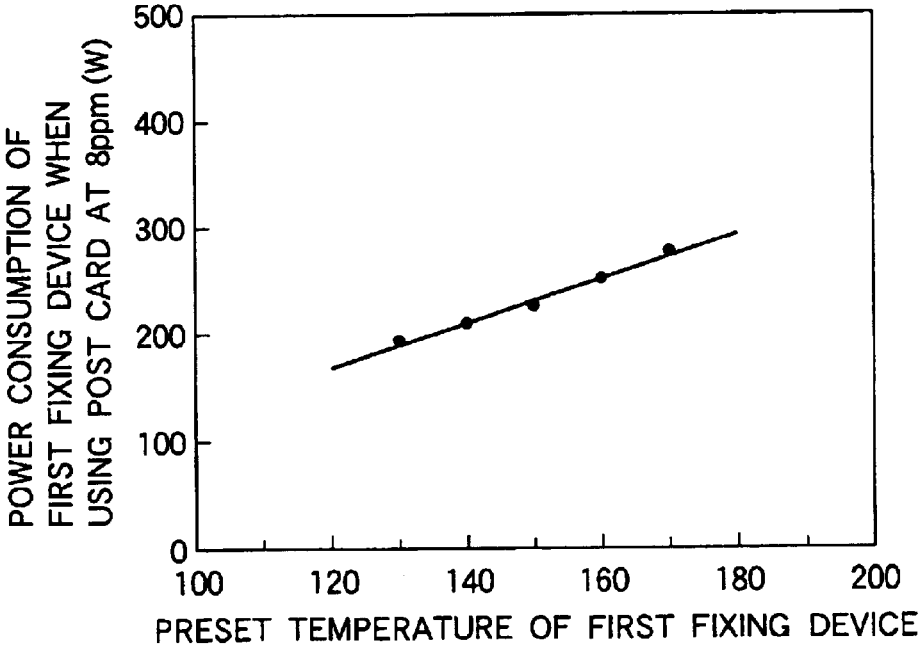
FIG. 9 is a graph showing a relationship between preset temperature of the first fixing unit and power consumption.

FIG. 9 is a graph explaining a relationship between the preset temperature TS1 of the first fixing device 25 and the power consumption by the first fixing device 25. The power consumption of the first fixing device 25 was measured while the preset temperature TS1 of the first fixing device 25 was stepwise varied to 130° C., 140° C., 150° C., 160° C. and 170° C. As seen from FIG. 9, when the preset temperature of the first fixing device 25 is changed from TS1(1)=170° C. for the normal mode to TS1(1)=140° C., enabling the temporarily fixing process, for the high gloss print mode, the power consumption of the first fixing device 25 in the high gloss mode is reduced from 274 W to 210 W.

A third measure employed in the embodiment is that the productivity in the high gloss print mode is lower than that in the normal print mode (for example, the half of the latter) Specifically, the productivity is 22 ppm in the normal print mode, and it is 8 ppm in the high gloss print mode.

Table 3 tabulates the power consumption by the first and second fixing devices 25 and 58 when the image forming system designed incorporating the first to third measures is operated in the normal print mode and the high gloss print mode

TABLE 3

| | Power consumption by first fixing device | Power consumption by second fixing dev | Total power consumption |
|---|---|---|---|
| <normal print mode><br>plain paper: 22 ppm | 625 W | — | 625 W |
| <high gloss mode><br>dedicated gloss paper: 8 ppm | 210 W | 380 w | 590 W |

In the normal print mode, the table 3 indicates power consumption required for the first fixing device 25 when an image is formed on a J paper (plain paper 16*a*), which is manufactured by Fuji Xerox Co. Ltd., at 22 ppm. In the high gloss print mode, the table 3 indicates power consumption required for the first fixing device 25 and the second fixing device 58 when the dedicated gloss paper 16*b* is fed at 8 ppm. As seen from the table 3, the overall (average) power consumption is more suppressed in the high gloss print mode, rather than in the normal print mode.

Figure 10:
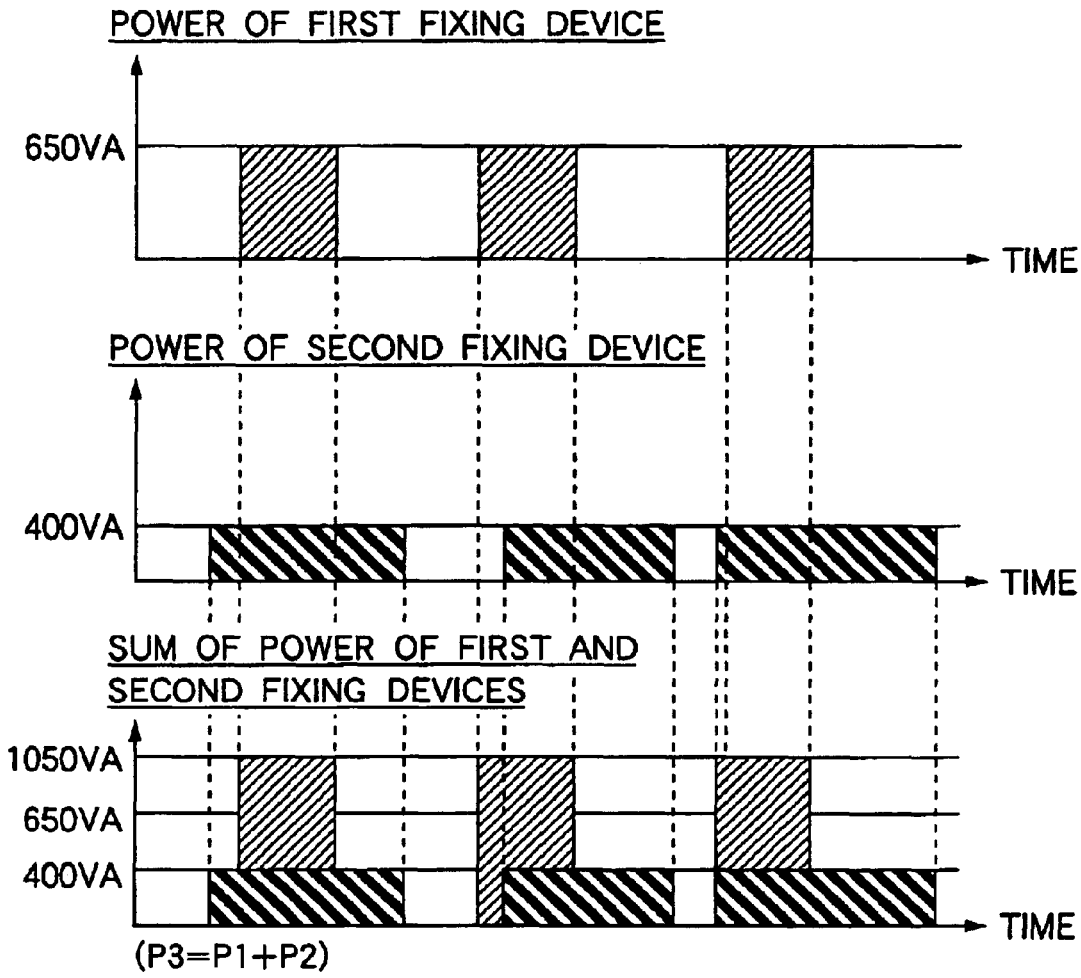
FIG. 10 is a chart showing a conventional electric power control logic.
Figure 11:
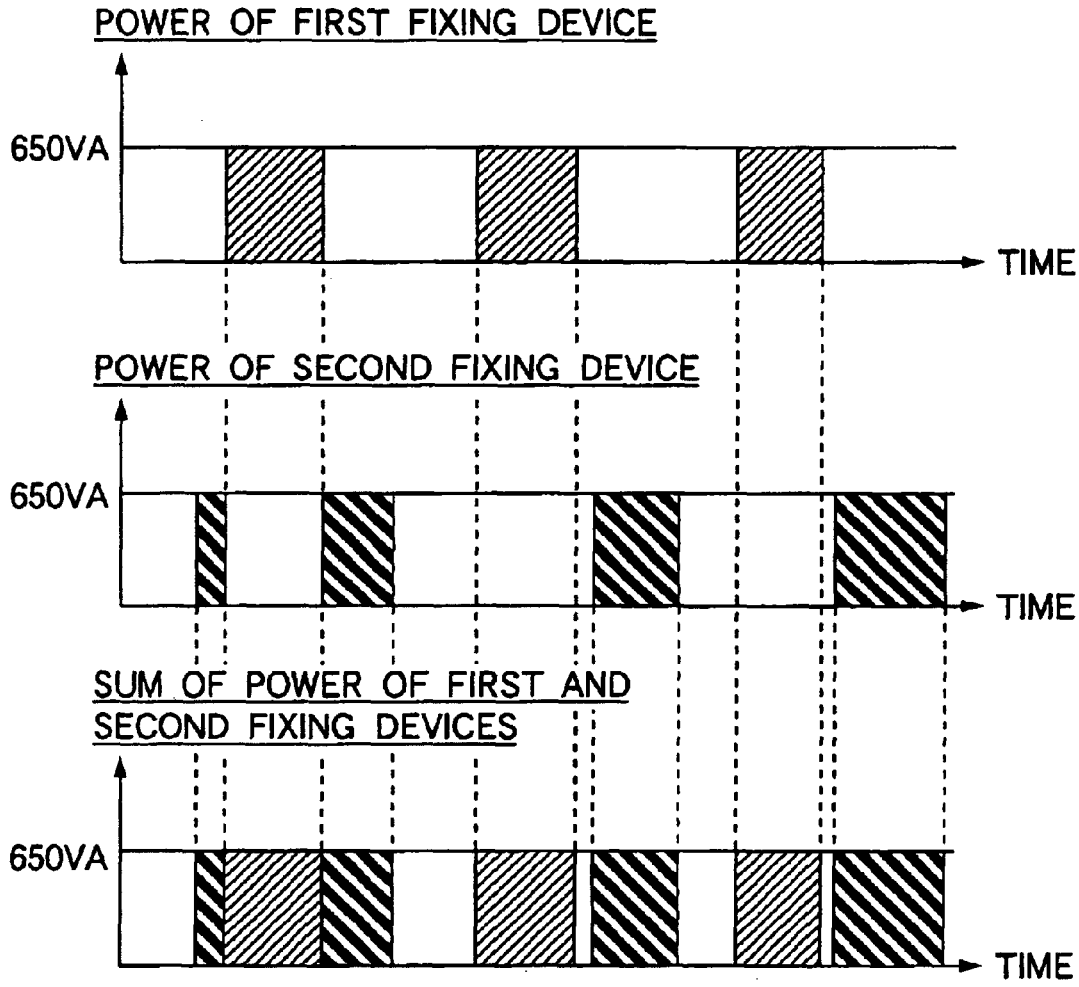
FIG. 11 is a chart showing an electric power control logic in an embodiment 1 of the invention.

A fourth measure to reduce the power consumption, employed in the embodiment, is that the timing of supplying the power to the first fixing device 25 (the halogen lamp 25*d*) is not coincident with that of supplying the power to the second fixing device 58 (the halogen lamp 69). FIG. 10 is a diagram showing a case where the timings of supplying power to the first and second fixing devices 25 and 58 are coincident with each other, and FIG. 11 is a diagram showing a case where the timings of supplying power to the first fixing devices 25 and 58 are not coincident. In FIGS. 10 and 11, time transition of the maximum power consumption of the first fixing device 25, that of the maximum power consumption of the second fixing device 58, and that of the total power consumption of the first and second fixing devices 25 and 58, are shown from the top in this order.

The first fixing device 25 includes the halogen lamp 25*d* of 650W so as to satisfy the required power consumption by the printing of the plain paper at 22 ppm in the normal print mode. In the high gloss print mode, the power consumption by the second fixing device 58 is 380W. Accordingly, use of the lamp 69 of about 400W as a heating source suffices for the conventional power control system. The average power consumption by the halogen lamp 25*d* of the first fixing device 25 in the high gloss print mode may be about 210W. In this case, however, the power control is the on/off control for the 650 W lamp.

As seen from FIG. 10, when the timings of supplying power to the first and second fixing devices 25 and 58 are coincident with each other, if the lamps 25*d* and 69 are both turned on at a timing, 1,050 W (650 W+400 W) is required at the maximum. Further, the whole image forming apparatus requires 1.5 kW or higher at the maximum (although the average power consumption is below 1.5 kW) since the unfixed image forming part other than the fixing devices, consumes about 800W.

In the embodiment, as seen from FIG. 11, the timings of supplying power to the first and second fixing devices 25 and 58 are not coincident with each other. Therefore, the total power consumption of the first and second fixing devices 25 and 58 never exceeds 650W. Thus, even if power of 800W consumed by the unfixed toner image forming part is added to the above power consumption, the total power consumption never exceeds 1.5 kW. Further, in the embodiment, a halogen lamp of 650W which is equal to that of the heating source of the first fixing device 25 is used for the heating source of the second fixing device 58.

Table 4 shows power consumption by all the sub-units of the conventional image forming system, an image forming system incorporating the first to third measures, and an image forming system incorporating first to fourth measures.

TABLE 4

| | Color copying machine and printer part | | Optional part to be equipped outside | | Power of the |
|---|---|---|---|---|---|
| | Unfixed toner image forming part | First fixing device | Image processing, etc. | Second fixing device | whole image forming system |
| Conventional belt width, not limited | 800 W | 650 W | 300 W | 980 W | 2,730 W |
| The belt width is limited | 800 W | 650 W | 300 W | 400 W | 2,150 W |
| Electric power is time shared with first fixing device | 800 W | 650 W | 300 W | (650 W)* | 1,750 W |

*Electric power is time shared with first fixing device.

As seen from the table 4, the power consumption is reduced in the order of the conventional image forming system, the image forming system incorporating the first to third measures, and the image forming system incorporating first to fourth measures.

Further, in the embodiment, when the fourth measure is used and both the temperature (T1 and T2) of the fuser roll 25*a* of the first fixing device 25 and the fuser roll 61 of the second fixing device 58 are below predetermined preset temperature (TS1(2) and TS2) in the high gloss print mode, electric power is supplied only to the heating source of the fuser roll having smaller thermal capacity. Specifically, the fuser roll 25*a* of the first fixing device 25 is designed such that its thermal capacity is small (approximately 28 cal/° C.), and has excellent thermal responsiveness. The fuser roll 61 of the second fixing device 58 is designed such that its thermal capacity is large (230 cal/° C.), and temperature variation is small. With this, when both the temperature of the fuser roll 25*a* of the first fixing device 25 and the fuser roll 61 of the second fixing device 58 are below the predetermined preset temperature, electric power is supplied to the fuser roll of small thermal capacity, viz., the halogen lamp 25*d* of the first fixing device 25 in this instance.

Table 5 shows temperature of the fixing devices 25 and 58 in the embodiment 1, and a temperature control logic when the temperature is set.

a temperature variation range, which is equal to that in the normal print mode, is used for the temperature control of the first fixing device 25, while the thermal responsiveness of the second fixing device 58 is intentionally set slow. By so doing, even if the lamp is prohibited from being turned on for 20 seconds, the temperature droop is made small, 10° C. or lower. In this way, the system which is operable by the electric power 2.0 kVA or lower, is successfully constructed, as shown in the table 5.

Embodiment 2

An embodiment 2 of the invention will be described.

In the embodiment, in addition to the total power of 1,750 W in the embodiment 1, the following electric power is consumed: 200W of a halogen lamp 69*a* (in addition to the halogen lamps 69 of 650 W) added to the fuser roll 61 of the second fixing device 58, and 200 W of a halogen lamp 69*b* added to the pressure roll 65. The fuser roll 25*a* (650W) of the first fixing device 25 and the halogen lamp 69 (650 W) of the second fixing device 58 are controlled so as not to be turned on simultaneously. The halogen lamp 69*a* (200 W) of the fuser roll 61 and the halogen lamp 69*b* (200 W) of the pressure roll 65, are also controlled so as not to be turned on simultaneously.

Table 6 tabulates a temperature control logic in this case. Table 7 tabulates the total power consumption of the embodiments 1 and 2.

TABLE 5

| | Temperature of first fixing device < preset temperature | | Temperature of first fixing device ≧ preset temperature | |
|---|---|---|---|---|
| | Temperature of second fixing device < preset temperature | Temperature of second fixing device ≧ preset temperature | Temperature of second fixing device < preset temperature | Temperature of second fixing device ≧ preset temperature |
| Power of first fixing device (650 W) | ON | ON | Off | Off |
| Power of second fixing device (650 W) | Off | Off | ON | Off |

As seen, by preferentially controlling the temperature of the fuser roll 25*a* of the first fixing device 25,

TABLE 6

| | Temperature of first fixing device < preset temperature | | Temperature of first fixing device ≧ preset temperature | |
|---|---|---|---|---|
| | Temperature of fuser roll of second fixing device < preset temperature Temperature of pressure roll of second fixing device < preset temperature | Temperature of fuser roll of second fixing device ≧ preset temperature Temperature of pressure roll of second fixing device < preset temperature | Temperature of fuser roll of second fixing device < preset temperature Temperature of pressure roll of second fixing device < preset temperature | Temperature of fuser roll of second fixing device ≧ preset temperature Temperature of pressure roll of second fixing device < preset temperature |
| Power of first fixing device (650 W) | ON | ON | Off | Off |
| Power of fuser roll of second fixing device (650 W) | Off | Off | ON | Off |
| Power of fuser roll of second fixing device (200 W) | ON | Off | Off | Off |
| Power of pressure roll of second fixing device (200 W) | Off | ON | ON | ON |

TABLE 7

| | Color copying machine and printer part | | Option part equipped outside | | |
|---|---|---|---|---|---|
| | Unfixed toner image forming part | First fixing device | Image processing, etc. | Second fixing device | The total power |
| Embodiment 1 of the invention (see FIG. 8) | 800 W | 650 W | 300 W | (650 W)* | 1,750 W |
| Embodiment 2 of the invention | 800 W | 650 W | 300 W | (650 W)* +200 W** | 1,950 W |

*Electric power is time shared with the first fixing device
**Electric power is time shared with fuser roll and pressure roll of second fixing device.

Since a couple of the halogen lamp 25*a* (650 W) of the first fixing device 25 and the halogen lamp 69 (650 W) of the fuser roll 61 and another couple of the halogen lamps 69*a* and 69*b* (both 200 W) of the fuser roll 61 and the pressure roll 65 of the second fixing device 58 are exclusively controlled, the maximum power is controlled to be below 1,950 W, and 2.0 kVA, as shown in Table 7. A control method for a couple of the halogen lamp 25*a* (650 W) of the first fixing device 25 and the halogen lamp 69 (650 W) of the fuser roll 61 is the same as shown in Table 5. A couple of the lamps 69*a* and 69*b* (both 200 W) of the fuser roll 61 and the pressure roll 65 of the second fixing device 58 are controlled to be turned on so as to compensates for it.

As shown in Table 6, when the 650W lamp of the fuser roll 25*a* of the first fixing device 25 is prohibited from being turned off, the lamp 69*a* of 200W of the fuser roll 61 of the second fixing device 58 is controlled preferentially. With this, the temperature variation of the fuser roll 61 of the second fixing device 58, which consumes large power because of the belt heating, is small. When the lamp 69 of 650 W of the fuser roll 61 of the second fixing device 58 is allowed to be turned on, the lamp 69*b* of 200 W of the pressure roll 65 of the second fixing device 58 is controlled to be turned on preferentially. In this way, the image forming system which stably controls temperature at 2.0 kVA or lower, is successfully constructed, as shown in Table 7.

Embodiment 3

An embodiment 3 of the invention will be described.

An image forming system of the embodiment incorporates the first to third measures for the power consumption reduction which are described in the embodiment 1, and further a fifth measure. The fifth measure, when the electric power is simultaneously supplied to both the halogen lamp 25*d* of the first fixing device 25 and the halogen lamp 69 of the second fixing device 58, cut-off power is supplied to the halogen lamps 25*d* and 69 so that the total of the supplied power is smaller in value than preset power.

Figure 12:
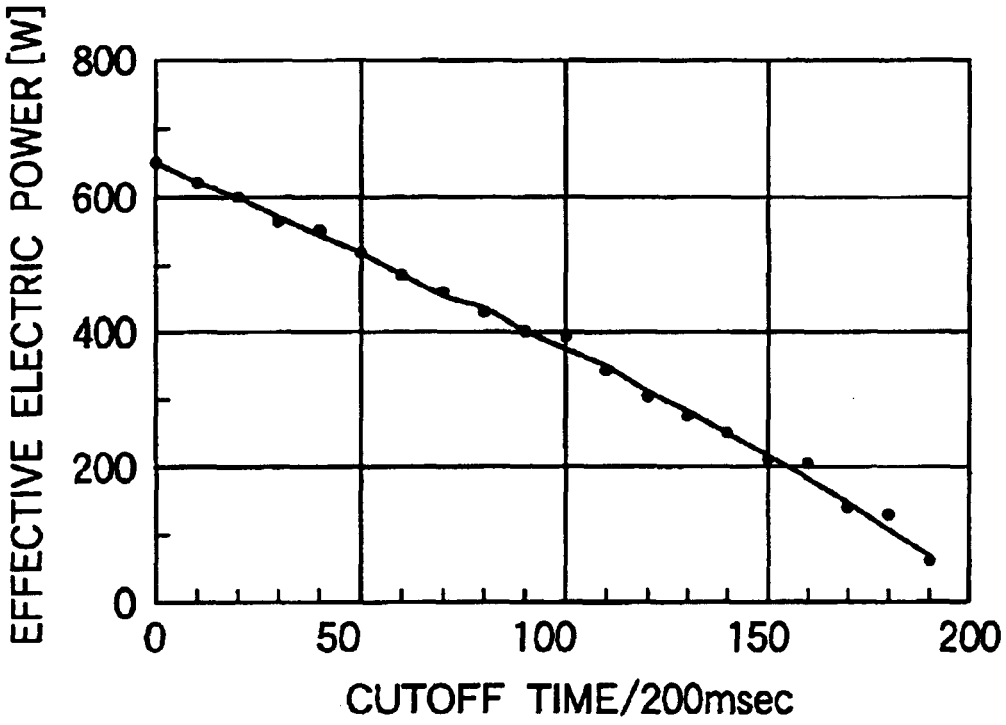
FIG. 12 is a graph showing a variation of electric power when cutoff control of the power is carried out.

FIG. 12 is a graph showing the results of measuring the output electric power while the cut-off time is varied from 10 to 190 msec, under the condition that one cycle of power source voltage of 650VA is 200 msec. The graph teaches that desired electric power may be supplied by adjusting the cut-off time.

Figure 13:
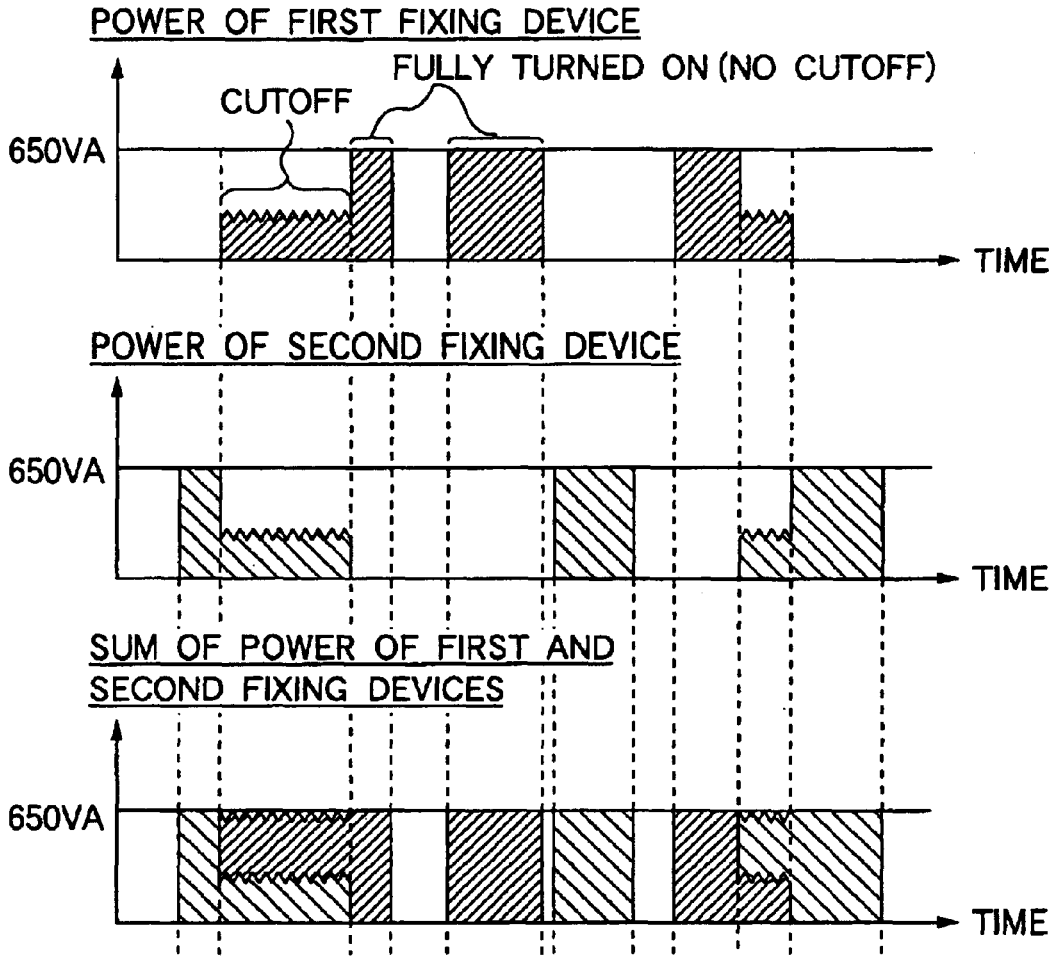
FIG. 13 is a chart showing an electric power control logic in an embodiment 2 of the invention.

FIG. 13 shows a time transition of the maximum power consumption of the first fixing device 25, the maximum power consumption of the second fixing device 58 and the total maximum power consumption of the first and second fixing devices 25 and 58. When the heating sources 25*d* and 69 of the first fixing device 25 and the second fixing device 58 are simultaneously turned on, the electric power for 120 msec of 200 msec is cut off to reduce the power of 650 VA to 308 W (see FIG. 12) to thereby reduce the sum of electric power of the heating sources 25*d* and 69 to 650W or lower.

In the embodiment, unlike the embodiment 1, even if the temperature values of the fuser rolls 25*a* and 61 of the first fixing device 25 and the second fixing device 58 are both below the preset temperature (TS1 (2) and TS2), both the halogen lamps 25*d* and 69 are simultaneously turned on. Therefore, the temperature droop of the fuser roll 61 is small when comparing with the image forming system of the embodiment 1.

As seen from the foregoing description, the invention succeeds in providing a color image forming apparatus which can produce a high gloss image by using the first and second fixing unit, without greatly increasing the maximum power consumption of the apparatus.

What is claimed is:

1. An image forming apparatus comprising:

an image forming unit for forming an unfixed toner image on a recording sheet;

a first fixing unit for fixing the unfixed toner image on the recording sheet;

a second fixing unit for further fixing the toner image on the recording sheet, which is fixed by the first fixing unit; and a control unit for selecting one of a first fixing mode in which only the first fixing unit is used for fixing the toner image on the recording sheet and a second fixing mode in which the first and second fixing unit are used for the fixing, wherein width of the recording sheet, which the second fixing unit can fix is narrower than that of the recording sheet, which the first fixing unit can fix.

2. The image forming apparatus according to claim 1, wherein the second fixing unit includes a plurality of rolls;

wherein an endless belt stretched around the rolls; and wherein a recording sheet is brought into close contact with a surface of the endless belt, and cooled, and peeled off the endless belt.

3. An image forming apparatus comprising:

an image forming unit for forming an unfixed toner image on a recording sheet;

a first fixing unit for fixing the unfixed toner image on the recording sheet at a predetermined temperature;

a second fixing unit for further fixing the toner image on the recording sheet, which is fixed by the first fixing unit; and a control unit for selecting one of a first fixing mode in which only the first fixing unit is used for fixing the toner image on the recording sheet and a second fixing mode in which the first and second fixing unit are used for the fixing, wherein the control unit sets the predetermined temperature of the first fixing unit in the second fixing mode to be lower than that of the first fixing unit in the first fixing mode.

4. An image forming apparatus comprising:

an image forming unit for forming an unfixed toner image on a recording sheet;

a first fixing unit including a first heating source, the first fixing unit for fixing the unfixed toner image on the recording sheet at a first predetermined temperature;

a second fixing unit including a second heating source, the second fixing unit for further fixing the toner image on the recording sheet, which is fixed by the first fixing unit at a second predetermined temperature; and a control unit for controlling electric power supplied to the first and second heating sources, wherein when temperature of the first fixing unit and temperature of the second fixing unit are below the first and second predetermined temperature, respectively, the control unit supplies electric power to one of the first and second heat source, which is smaller in thermal capacity than the other.

5. The image forming apparatus according to claim 4, wherein a thermal capacity of the first fixing unit is smaller than that of the second fixing unit.

6. An image forming apparatus comprising:

an image forming unit for forming an unfixed toner image on a recording sheet;

a first fixing unit including a first heating source, the first fixing unit for fixing the unfixed toner image on the recording sheet;

a second fixing unit including a second heating source, the second fixing unit for further fixing the toner image on the recording sheet, which is fixed by the first fixing unit; and a control unit for controlling electric power supplied to the first and second heating sources, wherein the second heating source includes a plurality of heating source elements; and wherein the control unit supplies electric power to the second heating source so that a quantity of heat generated by the second heating source at a timing of supplying electric power to the first heating source is smaller than that at a timing of supplying no electric power to the first heating source.

7. The image forming apparatus according to claim 6, wherein the second heating source includes two heating source elements, which are different in generated heat quantity;

wherein at the timing of supplying electric power to the first heating source, the control unit supplies electric power to one of the two heating source elements forming the second heating source, which is smaller in generated heat quantity; and wherein at the timing of supplying no electric power to the first heating source, the control unit supplies electric power to the other of the two heating source elements forming the second heating source, which is larger in generated heat quantity.

8. An image forming apparatus comprising:

an image forming unit for forming an unfixed toner image on a recording sheet;

a first fixing unit including a first heating source, the first fixing unit for fixing the unfixed toner image on the recording sheet;

a second fixing unit including a second heating source, the second fixing unit for further fixing the toner image on the recording sheet, which is fixed by the first fixing unit; and a control unit for controlling electric power supplied to the first and second heating sources, wherein when electric power is simultaneously supplied to the first heating source and the second heating source, the control unit supplies cut-off power to the first and second heating sources so that the sum of supplied electric power is below a predetermined power value.

9. The image forming apparatus according to claim 8, wherein the predetermined power value is below a maximum power consumption value, which is larger one of the maximum power consumption values of the first heating source and second heating source.

10. An image forming apparatus comprising:

an image forming unit for forming an unfixed toner image on a recording sheet;

a first fixing unit including a first heating source, the first fixing unit for fixing the unfixed toner image on the recording sheet;

a second fixing unit including a second heating source, the second fixing unit for further fixing the toner image on the recording sheet, which is fixed by the first fixing unit; and a control unit for controlling electric power supplied to the first and second heating sources, wherein the control unit executes such a control that a timing of supplying electric power to the first heating source is not coincident with a timing of supplying electric power to the second heating source, wherein the timing of supplying electric power to the first heating source includes a plurality of equal first time periods, and the timing of supplying electric power to the second heating source includes a plurality of sequentially increasing second time periods.

11. The image forming apparatus according to claim 10, wherein a first one of the plurality of first time periods begins after a first one of the second time periods and before a second one of the second time periods.

12. The image forming apparatus according to claim 10, wherein the timing of supplying electric power to the second heating source includes a first time period having a first full power ON sub-period and a second cutoff time sub-period, and the timing of supplying electric power to the first heating source includes a second time period having a first cutoff sub-period and a second full power ON sub-period.

13. The image forming apparatus according to claim 12, wherein the second cutoff time sub-period and the first cutoff sub-period are coincident.

14. The image forming apparatus according to claim 13, wherein the first full power ON sub-period ends before the first and second cutoff sub-periods begin.

15. The image forming apparatus according to claim 13, wherein the second full power ON sub-period begins after the first and second cutoff sub-periods end.

16. The image forming apparatus according to claim 12, wherein the timing of supplying electric power to the second heating source includes a second time period having a third full power ON sub-period, and the timing of supplying electric power to the first heating source includes a second time period having a fourth full power ON sub-period.

17. The image forming apparatus according to claim 16, wherein the third full power ON sub-period begins after the fourth full power ON sub-period ends.

18. The image forming apparatus according to claim 17, further including a fifth power OFF time period between the third full power ON sub-period and the fourth full power ON sub-period.

19. An image forming apparatus comprising:

an image forming unit for forming an unfixed toner image on a recording sheet;

a first fixing unit including a first heating source, the first fixing unit for fixing the unfixed toner image on the recording sheet;

a second fixing unit including a second heating source, the second fixing unit for further fixing the toner image on the recording sheet, which is fixed by the first fixing unit; and a control unit for controlling electric power supplied to the first and second heating sources, wherein the control unit executes such a control that a timing of supplying electric power to the first heating source is not coincident with a timing of supplying electric power to the second heating source, wherein the control unit supplies electric power to the second heating source so that a quantity of heat generated by the second heating source at a timing of supplying electric power to the first heating source is smaller than that at a timing of supplying no electric power to the first heating source.

20. An image forming apparatus comprising:

an image forming unit for forming an unfixed toner image on a recording sheet;

a first fixing unit including a first heating source, the first fixing unit for fixing the unfixed toner image on the recording sheet;

a second fixing unit including a second heating source, the second fixing unit for further fixing the toner image on the recording sheet, which is fixed by the first fixing unit; and a control unit for controlling electric power supplied to the first and second heating sources, wherein the control unit executes such a control that a timing of supplying electric power to the first heating source is not coincident with a timing of supplying electric power to the second heating source, wherein when electric power is simultaneously supplied to the first heating source and the second heating source, the control unit supplies cut-off power to the first and second heating sources so that the sum of supplied electric power is below a predetermined power value.

21. The image forming apparatus according to claim 20, wherein the predetermined power value is below a maximum power consumption value, which is larger one of the maximum power consumption values of the first heating source and second heating source.

* * * * *